United States Patent [19]

Morell et al.

[11] Patent Number: 4,660,300

[45] Date of Patent: Apr. 28, 1987

[54] TRACTION DEVICE FOR SKI BOOT

[75] Inventors: Joseph Morell, Annecy; Louis Benoit, Frangy; Maurice Bonnet, Rumilly, all of France

[73] Assignee: Salomon S.A., Annecy, France

[21] Appl. No.: 775,566

[22] Filed: Sep. 13, 1985

[30] Foreign Application Priority Data

Sep. 14, 1984 [FR] France ..... 84 14128

[51] Int. Cl.[4] ..... A43C 11/00; A43B 5/04

[52] U.S. Cl. ..... 36/50; 36/117; 36/119; 24/68 SK; 24/71.2

[58] Field of Search ..... 36/117-121, 36/50; 24/68 SK, 71.1, 71.2

[56] References Cited

U.S. PATENT DOCUMENTS 4,574,500 3/1986 Aldinio et al. ..... 36/119

FOREIGN PATENT DOCUMENTS 0053340 6/1982 European Pat. Off. ..... 36/117
0056953 8/1982 European Pat. Off. ..... 36/117
0120268 10/1984 European Pat. Off. ..... 36/117
0132744 2/1985 European Pat. Off. ..... 36/117
2900077 7/1980 Fed. Rep. of Germany ..... 36/50
3342121 6/1984 Fed. Rep. of Germany ..... 36/117

*Primary Examiner*—James Kee Chi
*Attorney, Agent, or Firm*—Pollock, Vande Sande & Priddy

[57] ABSTRACT

An alpine ski boot (1), the rod of which has a front collar (4) and a rear cap (5) arranged about a common axis (6), and the foot accommodating shell (2) of which houses, in its interior, a tarsal support casing (12). The collar (5) and the cap (6), on the one hand, and the casing (12), on the other hand, are respectively kept in position pressing against a skier's leg and against the kick portion of his foot, with a flexible brace (112) cooperating with an element (26) exerting traction by winding, allowing a phase of rapid approach, then a phase for the adjustment of the pressure applied to the skier's foot and leg.

7 Claims, 4 Drawing Figures

FIG. 3
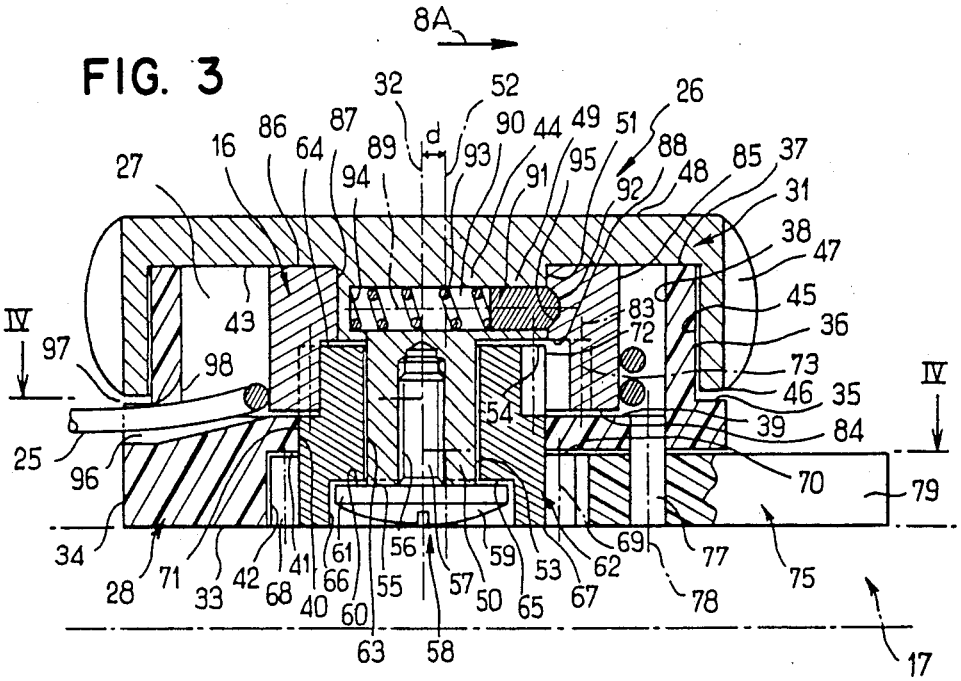
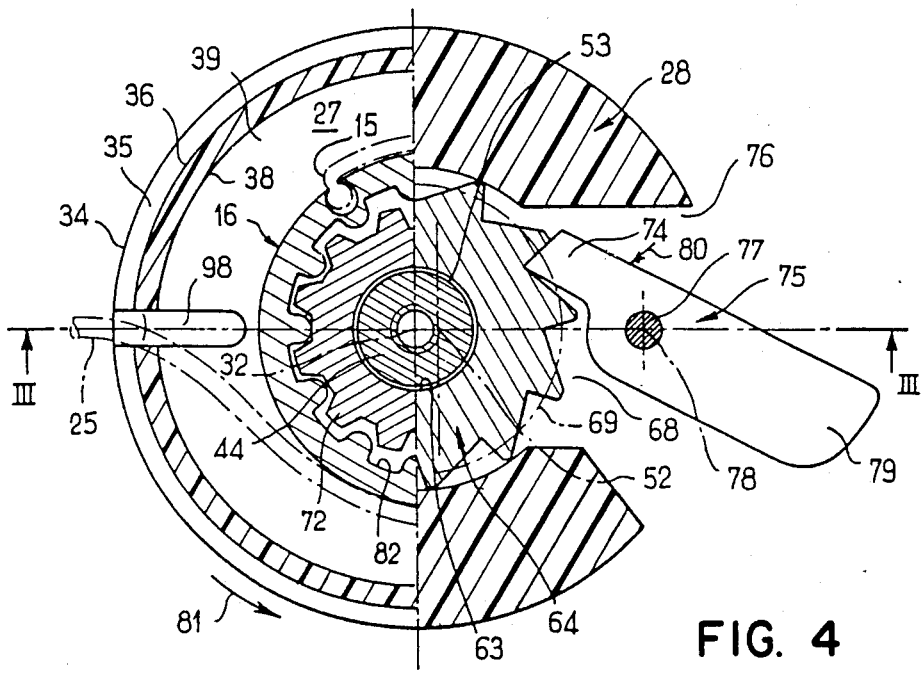
FIG. 4

TRACTION DEVICE FOR SKI BOOT

FIELD OF THE INVENTION

This invention pertains to a ski boot.

More precisely, it concerns an alpine-the ski boot of the type which includes:

at least two rigid elements defining a shell to accommodate a foot and a rod with a front collar and a rear cap, means of mutual assembly for said elements, defining a mutual arrangement of the collar and the cap in a lower zone of the rod, around an axis for relative horizontal and transversal pivoting with respect to a predetermined direction of forward movement, so that the cap and the collar can move between a relative open rod position and a variable relative position, of pressure of the cap and the collar against a leg, a tarsal support casing, placed inside the boot and mobile with respect to said elements, between a retraction position in which it is adjacent to the collar, in a lower zone of the rod, and/or to the shell in its front and upper zone, and a position pressing downward and to the rear on a foot, said pressing position being variable and offset towards the rear and downward with respect to the retraction position, a flexible brace, relatively inextensible, presenting two ends, a first of which is solid with one of said elements in immediate proximity to said axis, from a first side of the boot and inside of it, said flexible brace presenting, in addition, successively, from said first end to its second end, a first section bypassing the tarsal support casing in front and above, inside the boot, at a level above that of said first end, a second section crossing the collar in a first lateral zone of the rod, from a second side of the boot opposite said first side, to a second level above that of said first section and to that of said relative pivoting axis, a third section bypassing the cap through the rear, outside of the boot, and a fourth section running along the collar in a second lateral zone of the rod, outside of the boot, from its said first side, approximately to said second level, a guidance opening of said second section of flexible brace, crossing the collar in said first lateral zone of the rod, to said second level, means of traction held by the collar, in said second lateral zone of the rod, more or less at said second level, either to apply, to said fourth seciton of flexible brace, a traction sufficient to bring and maintain on one hand the cap and the collar in position pressing against a leg and, on the other hand, the tarsal support casing in the position pressing on a foot, or to free said fourth section of the flexible brace and to allow the passage of the cap and the collar into open retraction position and the passage of the tarsal support casing into retraction position.

In the preceding as in the following, one considers the boot in its normal use position and in reference to the predetermined direction of forward movement, to define any notion of relative positioning.

BACKGROUND OF THE INVENTION

A ski boot of this type is described by French Patent No. 2,536,965, in reference to FIG. 2 of this document, and presents the interest of allowing its user either to place the collar and the cap in open rod position and the tarsal support casing in retraction position to put the boot on or remove it, or to place the cap and the collar in position pressing against the leg and the tarsal support casing in position pressing against the foot to ensure the maintenance of the boot while skiing, through this user's action on the single means, namely on the means of traction on the flexible brace, itself acting at once on the tarsal support casing and on the collar and the cap constituting the rod.

In the case of the boot illustrated in FIG. 2 of French Patent No. 2,536,965 and described in reference to this Figure, the means of traction on the flexible brace are comprised of a lock lever, placed around an axis which is approximately vertical on the collar and with numerous anchoring points for the fourth section of the flexible brace; this fourth section presents the form of a loop and, between this fourth section and its second end, the flexible brace presents a fifth section bypassing the cap through the rear, outside the boot, and the second end of the flexible brace is anchored on the collar in a first lateral zone of the boot, at a level close to that of the opening provided for the passage of the second section; for this anchoring of the second end of the flexible brace, the collar, like the lever, presents multiple anchoring points; by choosing the anchoring point utilized on the lever and the anchoring point utilized on the collar, one can adjust the useful length of the flexible brace between its anchoring on the lever and the anchoring of its first end, i.e., the pressing position of the cap and the collar against the leg and the pressing position of the tarsal support casing on the heel of the foot, as well as the pressure which the cap and the collar on one hand, the tarsal support casing on the other hand, apply respectively to the skier's leg and kick portion of the foot in these respective positions.

Such a design presents the inconvenience of implementing a flexible brace with a long total length, measured between the two ends of the flexible brace, and of releasing this great length of the flexible brace when one places the cap and the collar in open position and the tarsal support casing in retraction position, notably, with the risks of tangling and hindrance for the user in putting the boot on or removing it; this inconvenience is all the more sensitive since French Patent No. 2,536,965 recommends, in reference to its FIG. 2, a bypassing of the relative pivoting axis of the cap and of the collar by the flexible brace between its first section, working together with the tarsal support casing and its second section crossing the collar.

In addition, the mode for adjusting the useful length of the flexible brace, defined above, by anchoring on the point appropriately chosen among numerous points respectively on the locking lever and on the collar, is revealed as inconvenient and does not necessarily result in the obtention of a pressing position of the cap and the collar against the leg, on one hand, a position of the tarsal support casing exerting pressure on the foot, on the other hand, which are completely satisfactory for all conformations of the leg and foot.

OBJECT OF THE INVENTION

The purpose of this invention is to correct these inconveniences and, for this purpose, this invention proposes to achieve the means of traction of the flexible brace in a form including:

a winding reel for the fourth section of the flexible brace, the second end of which is connected to a zone of the reel, means, held by the collar, to define a rotation axis for the reel with respect to the collar, or first axis, a control button for the reel rotating around said first axis, with respect to the collar, at least in one predetermined winding direction for the fourth section of the flexible brace, means, held by the collar, to define a rotation axis for the control button with respect to the collar, or second axis, first means of kinematic connection between the control button and the reel rotating around said second and first axes, respectively, with respect to the collar, said first means of kinematic connection introducing a second relation of transmission of the rotation of the button to the rotation of the reel, second means of kinematic connection between the control button and the reel rotating around said second and first axes, respectively, with respect to the collar, said second means of kinematic connection introducing a second relation of transmission of the rotation of the button to the rotation of the reel, downgraded with respect to the first relation, means for automatic switching between the first and second means of kinematic connection, automatically activating the first means of kinematic connection when the flexible brce undergoes a traction stress at a value which is greater than said threshold, means of temporary immobilization of the reel on rotation around said first axis, which respect to the collar, in the opposite direction of said predetermined winding direction of said predetermined winding direction.

Thus, the necessary length of the flexible brace is reduced, between its first and second ends; equally, the free length of the flexible brace in the open cap and collar position and in the retraction position of the tarsal support casing, i.e., also the risks of tangling of the flexible brace and hindrance for the user in these positions; this advantage is enhanced if, according to a preferred mode for implementation in this invention, the flexible brace follows an upward path from its first end to said second section, more or less on the entire first section, advantageously guided by a keeper held, toward the front, by the tarsal support casing.

In addition, in compact and esthetic form, the means of traction on the flexible brace recommended conforming to this invention allow an adaptation of the pressing position of the cap and the collar against a skier's leg and of the pressing position of the tarsal support casing on the foot, to any conformation of the leg and foot; these positions can be chosen as desired from a range which varies in a continuous manner; the cap and the collar, on one hand, the tarsal support casing, on the other hand, being assumed to initially occupy, respectively, the rod open position and the retraction position, the boot is put on by introducing the foot and the base on the leg into it, then, by initiating, through action on the control button, the winding of the flexible brace on the winding reel; until the cap and the collar, on one hand, the tarsal support casing, on the other hand, respectively reach the position pressing against the leg and the position pressing against the foot, only inevitable friction resists the movement of the cap and the collar on one hand, of the tarsal support casing, on the other hand, towards these respective positions, so that practically nothing resists the winding of the cable, the traction applied on the cable due to its progressive winding remains at a negligible value, less than the predetermined threshold for the automatic means of switching between the first and second kinematic connection means; thus, the passage from the open rod position and the retraction position, respectively, to the position pressing against the leg and the position pressing against the foot is effected while the first means of kinematic connection between the control button and the winding reel are in operation, such that the pressing position of the cap and the collar against the leg and the pressing position of the tarsal support casing against the foot are reached rapidly, and, nonetheless, contingent on the application of a moderated couple to the control button by the user; however, as soon as the positions in which the cap and the collar are pressing against the leg and the tarsal support casing is pressing against the foot are reached, the leg and the tarsal support casing is pressing against the foot are reached, the leg and the foot resist the pursuit of relative movement of the cap and the collar towards a closing of the rod and the movement of the tarsal support casing downward and towards the rear, i.e., in the pursuit of the winding of the flexible brace, which translates into an increase in the stress traction value on the latter and, contingent on an appropriate choice of the predetermined threshold associated with the automatic switching means, this choice being within the range of the normal capacity of one skilled in the art and effected such that it corresponds to the application to the skier's leg and the foot, respectively by the cap and the collar and by the tarsal support casing, of stresses which are less than those which are necessary to ensure a proper maintenance of the boot, causes the crossing of this threshold by the traction stress in the flexible brace, and consequently, an activation of the second means of kinematic connection between the control button and the reel, in place of the first means of kinematic connection; then, the pursuit of the rotation of the control button, by the user, cause the winding of the cable to be pursued, i.e., the movement of the cap and the collar and the tarsal support casing, towards the application to the leg and foot of a pressure which is appropriate to ensure an effective maintenance of the boot, while ensuring the user's comfort with a slower reel rotation speed with reduced winding, but a greater traction stress applied by the reel to the flexible brace, compared to the reel rotation speeds and traction stress applied to the flexible brace which exist when the first means of kinematic connection are in operation, with identity of rotation speed and couple applied with the control button by the user; thus, the pressing position against the leg and the pressing position on the foot which are best adapted to the conformation of the leg and foot are easily and rapidly obtained, regardless of these conformations, through the utilization of the first means of kinematic connection between the control button and the reel; subsequently, the user adjusts the tightness of the collar and the cap against the leg and the tarsal support casing against the foot through a progressive, comparatively slow application of tension to the flexible brace from the time that the means of automatic switching have substituted the second means of kinematic connection for the first means of kinematic connection; next, the means of temporary immobilization of the reel on rotation in the direction opposite the winding direction ensure the maintenance of the cap and the collar on one hand, of the tarsal support casing, on the other hand, in the positions reached; an action on these means of temporary immobilization, accompanied by an action on the cap and the collar in the rod opening direction, subsequently allow the release of the foot for the removal of the boot.

BRIEF DESCRIPTION OF THE DRAWINGS

However, the practical assembly of a boot conforming to this invention can remain simple, reliable and economical, utilizing a small number of parts, as will appear from the description below, pertaining to a non-limitative exemplary embodiment, as well as the annexed diagrams, which are an integral part of this description.

FIG. 3 shows a view of the means of traction on the flexible brace equipping the boot in FIGS. 1 and 2, in section, through the plane III—III in FIG. 4, including the respective rotation axes, which are combined in this example, of the winding reel and the control button with respect to the collar.

FIG. 4 shows a section view of these means through planes IV—IV in FIG. 3.

DESCRIPTION OF PREFERRED EMBODIMENT

Figure 1:
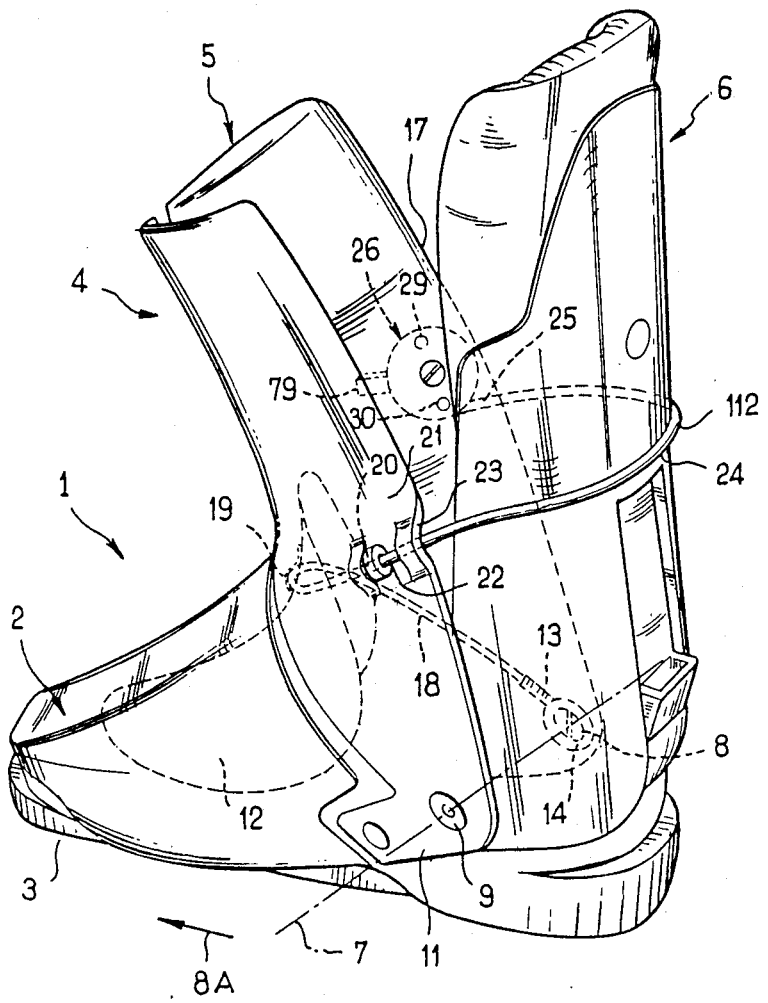
FIG. 1 shows a perspective view of a boot according to the invention, the cap and collar of which are in relative rod open position.
Figure 2:
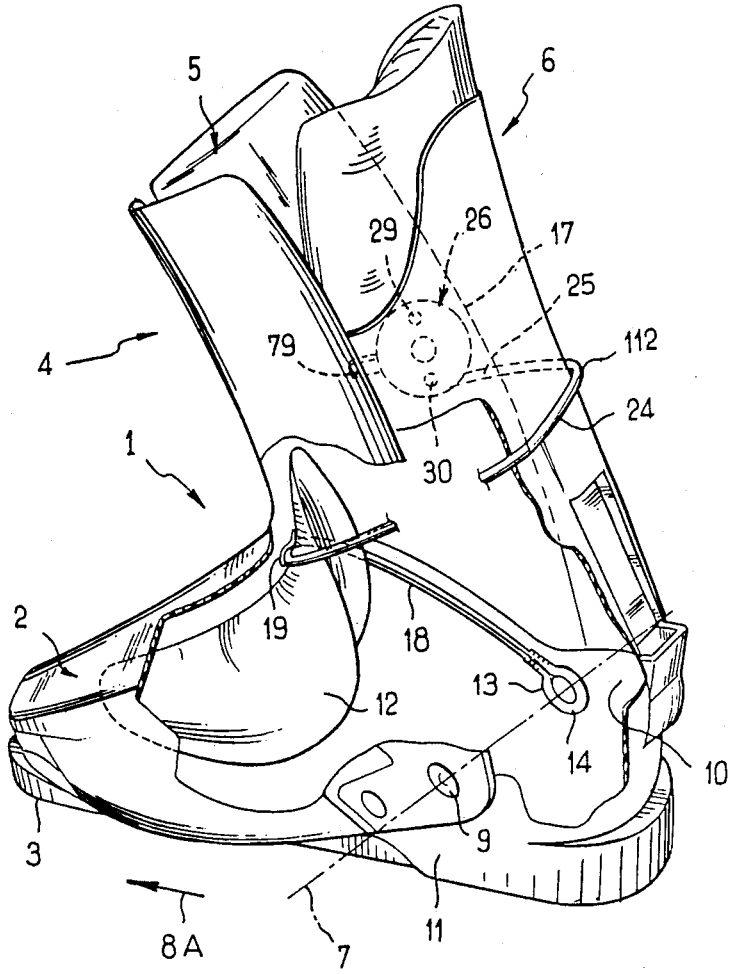
FIG. 2 shows a perspective view of this boot, partly in section, in which the cap and the collar are in closed rod position, which can constitute a position pressing against a skier's leg.

In the first place, one will refer to FIGS. 1 and 2, where, in a general manner, a ski boot has been designated by 1, this ski boot having, in a manner known in itself, a rigid lower shell 2 forming a sole 3 and destined to accommodate a skier's foot inside, and a rod 4 projecting upwardly above the shell 2 to accommodate the base of the skier's leg; in a manner which is also known, the rod 4 is comprised of two rigid elements applied to the shell 2, namely a front element or collar 5 and a rear element or cap 6, arranged mutually in a lower zone of the rod, around an axis 7 which is horizontal and transversal with respect to a predetermined direction 8A of normal forward movement, to allow the possibility of movement between a relative open rod position, illustrated in FIG. 1, in which the collar 5 and the cap 6 are separated from each other in an upper zone of the rod to allow the engagement or disengagement of the foot with respect to the boot, and a related closed rod position, illustrated in FIG. 2, in which the collar 5 and the cap 6 are as close as possible to the upper part of the rod and are potentially exerting pressure against the base of the skier's leg; the collar 5 and the cap 6 can also occupy any intermediate position between these two limit positions, through relative pivoting around the axis 6, to adapt against the base of the skier's leg, contingent on a pressure which can be chosen by the latter; this intermediate position, essentially variable as a function of the conformation of the leg of the skier and of the pressure he considers most appropriate to ensure a proper maintenance of the boot as well as the proper comfort in use, has been represented only in the case in which it coincides with the rod (3) closed limit position, illustrated in FIG. 2.

In a manner which is known in itself and as illustrated, the collar 5 can be attached with respect to the shell 2, in which case only the cap 6 pivots, at once with respect to the collar 5 and with respect to the shell 2, around the axis 7 formed by two and 8 and 9 connecting the cap 6, the collar 5 and the shell 2 respectively of a first side 10 (hidden in FIG. 1 and seen in FIG. 2 due to the partial section) and of a second side 11 of the boot 1, laterally with respect to the direction 8; however, one would not depart from the framework of this invention by providing a different assembly in which the collar 5 could pivot around the axis 7 with respect to the shell 2.

These arrangements are known to those skilled in the art and will not be further described.

As also known by those skilled in the art, for example, through French Patent No. 2,536,965, inside of the boot 1 is placed, in a mobil manner with respect to the shell 2, with respect to the collar 5, and with respect to cap 6, a tarsal support casing 12, with an anatomical form adapted to the shape of the kick portion of the foot; this casing 12 can occupy notably, within the boot 1, a retraction position (not shown) in which it is adjacent to the collar 5 in a lower zone of the rod and to the shell 2 in an upper front zone of the latter; it can also occupy a position pressing downward and to the rear on a foot, this pressing position being variable according to the conformation of the skier's foot, and shifted toward the rear and downward with respect to the retraction position; in this pressing position, illustrated in FIGS. 1 and 2, the tarsal support casing 12 ensures the maintenance of the skier's heel in the heel of the boot, defined by a rear zone of the shell 2, while the passing of this casing 12 to the retraction position allows the boot to be put on and taken off.

To simultaneously cause the passage of the collar 5 and the cap 6 into the position pressing against a skier's leg and that of the casing 12 into position pressing against the skier's foot, when the boot is being put on, or to simultaneously allow the passage of the collar 5 and the cap 6 into the open rod position and that of the casing 12 into the retraction position to allow the boot to be put on or taken off, a single bracket 12 is provided, which is relatively inextensible and, for example, comprised of a covered metal cable, with two ends, a first of which has a loop 14 anchored on the pivot 8 of the first side 10 of the boot, inside it, and the second 15 of which is fastened by any known means to a winding reel 16 which will be described below in reference to FIGS. 3 and 4 and which itself is supported by the collar 5, close to the rear limit of the latter in a lateral zone 17 of the rod 4, on the same side 10 of the boot 1 as the pivot 8 anchoring the loop 14 on the end 13 of the flexible brace 12, but outside of the boot 1 and at a level above that of the axis 7.

From its first end 13 to its second end 15, the flexible brace 12 successively presents:

a first section 18 which, in an upward path on virtually all of it, from the loop 14 on the end 13 of the flexible brace 12, running along the cap 6 and the collar 5 through the inside of the boot, going upward towards the front from the loop 14, then bypasses through the front and upward, inside of the boot, at an intermediate level between that of the axis 7 and that of the lateral zone 17 of the rod 4 holding the winding reel 16, the casing 12, which advantageously presents, at this level, towards the front and upward, a guidance keeper 19 for the section 18 of the flexible brace 12 on it, sliding following a direction which is approximately parallel to that of the axis 7, and finally rises towards the rear along the collar 5, inside of the boot and from its second side 11, to an opening 20 which is placed on this side 11 of the shoe, in a lateral zone 21 of the collar 5, near its rear limit on this side 11, second section 22 passing through the collar 5 through the opening 20 and advantageously guided along it, outside of the boot and behind the opening 20, through a guidance keeper 23, ensuring this second section 22 an upward path towards the rear from the hole 20, a third section 24, which, following after the second section 22, bypasses the cap 6 through the rear, outside of the boot, a fourth section 25 after the third section 24 and running along the lateral zone 17 of the rod 4 outside of the boot, up to the winding reel 16 on which this fourth section 25 winds partially, up to the end 15 of the brace 12.

The medium respective levels of the second section 22 and the fourth section 25 of the flexible brace 2, i.e., the medium respective levels of the lateral zones 21 and 17 of the rod 4, coincide approximately.

Those skilled in the art will easily understand that, by applying a forward traction to the fourth section 25 of the flexible brace 12, notably by winding on the reel 16, one causes at once a movement of the casing 12, assumed initially in retraction position, towards the rear and downward, and a movement of the cap 6, assumed initially in open rod 4 position, forward, with respect to all of the zones of the cap 6 located above the axis 7, contingent on a sliding of the flexible brace 12 on itself on one hand against the casing 12, notably inside the keeper 19, and, on the other hand, against the collar 5 and the cap 6 to be brought back to the open position and the casing 12 to the retraction position.

For this purpose, the reel 16 is an integral part of the means 26 of traction for the section 25 of the flexible brace 12; these means 26 will be described now in reference to FIGS. 3 and 4, from which it emerges that the reel 16 is integrally closed on the inside 27 of a housing defined on one hand by a casing box 28 for the means 26, this casing box 28 is connected to the collar 5 in the lateral zone 17 of the rod 4 by any appropriate means and, for example, by a screwed joint, as shown diagrammatically in 29 and 30 in FIGS. 1 and 2, and, on the other hand, by a control button 31 for the means of traction 26, which button 31 covers the casing box 28 opposite the collar 5 and is mounted in rotation on the casing box 28 around an axis 32 attached with respect to the casing box 28 and with respect to the control button 31, and oriented approximately in parallel with the axis 7 when the casing box 28 is connected to the collar 5 in the lateral zone 17 of the rod 4.

For a flush contact with the collar 5, on its outside, in the lateral zone 17 of the rod 4, the casing box 28 presents a planar annular side 33, revolving around the axis 32 to which it is perpendicular; in the direction of a radial distancing with respect to the axis 32, the side 33 connects to a cylindrical side 34, revolving around the axis 32 and which connects the side 33 to an annular planar side 35, revolving around the axis 32 to which it is perpendicular; this side 35, oriented in the opposite direction as the side 33, is delimited in the direction of a radial distancing with respect to the axis 32 through its connection with the side 34, and in the direction of a radial rapprochement with respect to the axis 32 through a connection with a cylindrical side 36 revolving around this axis 32 with a diameter which is smaller than that of the side 34, like which this side 36 is turned in the direction of a radial distancing with respect to the axis 32; the side 36 itself connects the side 35 to an annular planar side 37, revolving around the axis 32, to which it is perpendicular; this side 37, oriented as the side 35, is delimited by its connection with the side 36 in the direction of a distancing with respect to the axis 32 and in the direction of a radial rapproachement with respect to this axis, it is delimited by its connection with a cylindrical side 38 revolving around the axis 32 and turned towards it, with a diameter which is smaller than that of the side 36; in the direction of a rapprochement with respect to the side 33, parallel to the axis 32, the side 38 connects the side 37 to an annular planar side 39, revolving around the axis 32, to which it is perpendicular, this side 39 presenting an orientation identical to those of sides 37 and 35, and opposite that of side 33; parallel to the axis 32, the side 38 presents, between the sides 37 and 39, an intermediate length between that of the side 36 between the sides 37 and 35 and that which separates the sides 37 and 33, parallel to the axis 32; the side 39 is delimited, in the direction of a radial distancing with respect to the axis 32, by its intersection with the side 38 and, in the direction of a radial rapprochement with respect to the axis 32, by its intersection with a cylindrical side 40 revolving around the axis 32, towards which it is turned, with a diameter inside that of the side 38; parallel to the axis 32, this side 40 presents a length which is smaller than the difference between the distance separating the sides 37 and 33 parallel with the axis 32 and the length of the side 38 parallel with the axis 32 and the length of the side 38 parallel to this axis and, in the direction of a rapprochement with respect to the side 33 parallel to the axis 32 and the length of the side 38 parallel to this axis and, in the direction of a rapprochement with respect to the side 33 parallel to the axis 32, the side 40 connects the side 39 to an annular planar side 41, revolving around the axis 32 to which it is perpendicular, this side 41 being turned in the same direction as the side 33; delimited in the direction of a radial rapprochement with respect to the axis 21 through its intersection with the side 40, the side 41 is delimited in the direction of a radial distancing with respect to the axis 32 by intersection with a cylindrical side 42 revolving around the axis 32 and which connects this side 41 to the side 33, delimited in the direction of a radial rapprochement with respect to the axis 32 through its intersection with this side 42 with an intermediate diameter between that of the side 40 and that of the side 34.

The button 31 presents, in sliding contact, flush with the side 37, an annular planar side 43 which is also perpendicular to the axis 32 with the same orientation as the side 33; this side 43 is delimited, in the direction of a radial rapprochement with respect to the axis 32, through its intersection with a rod 44 which will be described below, and forms a projection with respect to this side 43 at the interior 27 of the housing defined jointly by the casing box 28 and the control button 31; in the direction of a radial distancing with respect to the axis 32, the side 43 is delimited by intersection with a cylindrical side 45 revolving around the axis 32 towards which it is turned, this side 45 having a diameter which is close to that of the side 36 opposite which it is placed, such that a mutual sliding contact is established between the sides 45 and 36; the side 45 connects, parallel to the axis 32, the side 43 to an annular planar side 46, revolving around the axis 32, the side 43 to an annular planar side 46, revolving around the axis 32 to which it is perpendicular, with the same orientation as the side 43; this side 46 is located at a distance from the side 43, measured in parallel with the axis 32 and corresponding to the length of the side 45, slightly smaller than the distance separating the sides 35 and 37, such that the side 46 is placed facing the side 35, at a negligible distance from it, when the sides 43 and 37 are in mutual sliding contact; delimited in the direction of a radial rapprochement with respect to the axis 32 through its intersection with the side 45, the side 46 is delimited in the direction of a radial distancing with respect to the axis 32 by intersection with a padded side 47, in a general form revolving around the axis 32 and turned in the direction of a radial distancing with respect to it, with a minimum diameter greater than that of the side 45; the padded side 47 connects, parallel with the axis 32, the side 46 to a side 48 in the shape of a planar disc, revolving around the axis 32, to which this side 48 is perpendicular, the distance separating the sides 46 and 48 parallel to the axis 32 being greater than the parallel distance separating this axis from the sides 43 and 46.

One will note that the sliding contact between the sides 36 and 45 contributes to a mutual guidance of the control button 31 and the casing box 28 on relative rotation around the axis 32.

Inside 27 the housing delimited by the casing box 28 and the control button 31, the rod 44 of the control button 31, with which this rod 44 is advantageously made in one piece, presents two sections 49 and 50; the first section 49 constitutes the zone of the rod 44 which is closest to the side 43 and is delimited in the direction of a radial distancing with respect to the axis 32 by a cylindrical side 51 revolving around an axis 52 which is parallel to the axis 32 and shifted with respect to this axis 32 by a distance d which is sufficiently small so that the axes 32 and 52 are both located inside this side 51, i.e. less than the radius of the side 51, in reference to the axis 52; in addition, the side 51 presents a diameter which is smaller than the difference between the diameter of the side 38 and twice the distance separating the axes 32 and 52, such that, between the sides 51 and 38, there remains a continuous annular space; the side 51 delimits the side 43 in the direction of a radial rapprochement with respect to the axis 32, and connects this side 43 to an annular, planar side 54 which is perpendicular to the two axes 32 and 52 and being shorter than the length of the side 38 measured in the same manner between the sides 37 and 39; the side 54 connects, in the direction of a radial approchment with respect to the axis 32, the side 51 to a cylindrical side 53 revolving the respect to the axis 32 and turned in the direction of a radial distancing with respect to it, with a diameter which is smaller than the difference between the diameter of the side 51 and twice the distance d separating the axes 32 and 52 such that the side 54 defines a continuous shoulder around its intersection with the side 53; in addition, the diameter of the side 53 is greater than twice the distance d separating the axes 32 and 52 in the embodiment illustrated, such that the axis 52 is located on the inside of the side 53; this side 53 delimits the second section 50 of the rod 44 in the direction of a distancing with respect to the axis 52; delimited on one hand by its connection with the side 43 parallel to the axes 32 and 52, the side 53 is, on the other hand, delimited in the direction of a distancing with respect to the side 43, parallel to these axes, by connection with an annular planar side 55 turned in the same manner as the side 43 and revolving around the axis 32, to which it is perpendicular; delimited in the direction of a radial distancing with respect to the axis 32 through its intersection with the side 53, the side 55 is delimited in the direction of a radial rapprochement with respect to the axis 32 by its intersection with a threaded hole 56, of the axis 32, placed in the rod 44 to accommodate a threaded rod 57 of a screw 58 which, in addition, has a head 59 which presses against the side 55 through an annular planar side 60, revolving around the axis 32 to which it is perpendicular, this side 60, being delimited in the direction of a radial rapprochement with respect to the axis 32 by its intersection with rod 57 and in the direction of a radial distancing with respect to the axis 32 by connection with an edge of the head 59; this edge 61 is cylindrical, revolving around the axis 32 with an intermediate diameter between that of the side 53 and that, greater than that of the side 53, of the side 40 of the casing box 28 such that the side 60 defines around the side 53 an annular shoulder turned towards the side 54; one will note that the distance separating the side 55 from the side 43 parallel with the axis 32 is smaller than the distance separating, parallel to this axis, sides 37 and 33, such that the head 59 of the screw 58 does not form a projection with respect to the side 33.

Between the shoulder thus defined by the side 60 of the head 59 of the screw 58 and that defined by the side 54 on the rod 44, is inserted, on the section 50 of the rod 44, a mounted component 62, fastened to the rod 44, i.e., with the button 31, utilizing any means and notably by tightening between the sides 60 and 54 with the screw 58 and, in a manner which is not shown but easily conceivable for one skilled in the art, by wedging.

The component 62 presents the general form of a sleeve revolving around the axis 32; towards this axis 32, it presents a cylindrical side 63 revolving around it with the diameter corresponding approximately to that of the side 53 of the second section 50 of the rod 44 to establish mutual contact between these two sides 63 and 53; the side 63 presents, parallel to the axis 32, a length which is approximately identical to that of the side 53 of the section 50, between two annular, planar sides which are perpendicular to the axis 32 with a side 64 turned towards the side 54 of the rod 44 and a side 65 turned in the opposite direction, towards the side 60; the sides 64 and 65 are placed in immediate proximity to the sides 54 and 60, respectively, and potentially in contact under pressure with the latter when the component 62 is connected with the button 31 by tightening with the screw 58.

Delimited by its intersection with the side 63 in the direction of a radial rapprochement with respect to the axis 32, the side 65, revolving around the axis 32, is delimited in the direction of a radial distancing with respect to it by its intersection with a cylindrical side 66 revolving around the axis 32 and turned towards the latter, which side 66 connects the side 65 to an annular planar side 67, perpendicular to the axis 32 and coplanar with the side 33, oriented in the same direction; the diameter of the side 66 is greater than that of the side 63 and greater than that of the edge 61 of the head of the screw 58 but less than that of the side 40 of the casing box 28; delimited in the direction of a radial rapprochement with respect to the axis 32 by its intersection with the side 66, the side 67 is delimited in the direction of a radial distancing with respect to the axis 52 by its intersection with a ratchet gear 68, of which it defines a first edge perpendicular to the axis 32; the ratchet gear 68, which one will note can also be formed by a ratchet wheel fastened by any means to the component 62 instead of being made in one piece with the latter, presents a cylinder 69 revolving around the axis 32, a maximum intermediate diameter between the respective diameters of the sides 40 and 42 of the casing box 28, and it is delimited by a second annular edge 70, perpendicular to the axis 32, this edge 70 being turned in the opposite direction to the side 67 and placed at a distance from it, parallel to the axis 32, approximately identical to the distance separating, parallel to this axis, sides 41 and 33 of the casing box 28 such that the edge 70 of the ratchet gear 68 constitutes, with the side 41 of the casing box 28, on one hand, the side 43 of the button 31 and the side 37 of the casing box 28, on the other hand, a stop mechanism resisting any relative displacement of the solidary button 31—component 62 group and of the casing box 28 parallel to the axis 32; radially towards the axis 32, the edge 70 is delimited by intersection with a side 71 of the component 62, which side 71 is cylindrical, revolving around the axis 32 and turned in the direction of a radial distancing with respect to it, with a diameter which is approximately identical to that of the side 40 of the casing box 28 such that it establishes, between the sides 71 and 40, a sliding contact, ensuring a mutual guidance of the component 62, i.e., also of the button 31, and of the casing box 28 on relative rotation around the axis 32; this side 71 presents, parallel to the axis 32, a length which is approximately identical which is approximately identical to that of the side 40, i.e., to the distance separating parallelly to the axis 32 the sides 41 and 39 of the casing box 28, and it connects, parallel to the axis 32, the edge 70 of the toothing 68 to a virtual cylinder, of axis 32, and with the same diameter as the side 71, this virtual cylinder constituting the cover for a second toothing 72 of the axis 32, of the primitive cylinder 73 revolving around the axis 32 with an intermediate diameter between that of the side 71 and that of the side 63; this toothing 72 constitutes, on the component 62, a toothed annular gear, which can also be applied to this component 62, so that it is fastened to it; the toothing 72 has a minimum diameter greater than that of the side 63, to which this toothing 72 is connected, in the direction of a radial rapprochement with respect to the axis 32, by the side 64.

The ratchet gear 68, located between the sides 33 and 39 of the casing box 28, cooperates with a pawl 74 of a lever 75 also placed between the sides 39 and 33, in an appropriate indentation 76 cut into the side 33 and giving, on one hand on to the side 42 and on the other hand, to the side 34 of the casing box 28; inside the indentation 76, the lever 75 is mounted on a pivot shaft 77 which is connected to the casing box 28 and which defines an axis 78, parallel to the axis 32, of rotation of the lever 75 with resepct to the casing box 28; opposite the pawl 74 with respect to the axis 78, outside of the casing box 28, the lever 75 presents, in addition, a manual activation zone 79 of action, allowing the user to release the pawl 74 when desired, with respect to the ratchet gear 68; the engagement of the pawl 74 in this toothing 68 results from the action of a spring, and, for example, of a kick-over spring, which is not represented, but is indicated schematically by an arrow 80 in FIG. 4; thus, when the pawl 74 is engaged in the toothing 68, it prevents the rotation of the component 62—button 31 solidary group around the axis 32 with respect to the casing box 28 in the opposite direction from the predetermined winding direction 81 for the flexible brace 21 on the reel 16, while nonetheless allowing, through the elastic play of the spring 80 and due to an appropriate shape, which can easily be determined by one skilled in the art, of the pawl 74 and of the ratchet gear 68, a rotation of the component 62—button 31 group in the direction 81 around the axis 32 with resepct to the casing box 28; only a manual action by the user on the part 79 of the lever 75 allows, by releasing the pawl 74 from the ratchet gear 68, the turning of the component 62—button 31 group in the opposite direction of the direction 81, around the axis 32, with respect to the casing box 28.

The toothed annular gear 72 is located inside 27 the control button 47—casing box 28 group, and cooperates with an internal toothing or toothed annular gear 82 of the reel 16.

This reel 16 presents a general form revolving around the axis 52 and, notably, the toothed annular gear 82 presents a primitive cylinder 83 revolving around the axis 52, with a diameter equal to the sum of the diameter of the primitive cylinder 73 of the toothed annular gear 72 of the component 62 and twice the distance d separating the axes 32 and 52, such that the toothd annular gears 72 and 82 mutually engage, while introducing a step-down in the rotation of the annular gear 72 around the axis 32 to a rotation of the annular gear 82 around the axis 52.

The annular gears 62 and 82 are always opposite each other radially in reference to either of the axes 32 and 52, and present, parallel to these axes, a length which is approximately identical, and, moreover, approximately identical to the difference between the distance separating, parallel to the axes 32 and 52, the sides 37 and 39 of the casing box 28 and the distance separating, parallel to these axes, sides 43 and 54 of the button 31; for this purpose, the annular gear 82 is delimited, with respect to the side 39 of the casing box 28, by an annular planar side 84, perpendicular to the axes 32 and 52; this side 84 is delimited in the direction of a radial rapprochement with respect to the axis 52 by its intersection with the toothing of the annular gear 82, and in the direction of a radial distancing with respect to the axis 52 by intersection with a cylindrical side 85 revolving around the axis 52 and turned in the direction of a radial distancing with respect to it; this side 85 constitutes, for the reel 16, the winding side of the fourth section 25 of the flexible brace 12; it has a diameter greater than the maximum diameter of the toothed annular gear 82, as well as the diameter of the side 51 than which this maximum diameter of the toothed annular gear 82 is greater, as, moreover, the minimum diameter of this toothed annular gear 82 in the illustrated embodiment; the diameter of the side 85 is nonetheless smaller than the difference between the diameter of the side 38 and twice the distance d separating the axes 32 and 52 such that, between the sides 85 and 38, there remains a continuous annular clearance for the winding of the fourth section 25 of the flexible brace 12; the side 85 connects, parallel to the axis 52, the side 84 to an annular planar side 90, revolving around the axis 52 to which it is perpendicular and of opposite orientation to that of the side 84, the distance separating the sides 84 and 86 parallel to the axis 52 being approximately identical to the distance separating the sides 37, or 43, and 39 parallel to the axes 32 and 52 such that the sides 84 and 86 are placed respectively facing the sides 39 and 43, with a negligible relative clearance, to thus ensure an immobilization of the reel 16 sliding parallel to the axes 32 and 52 with respect to the control button 31 and the casing box 28; delimited in the direction of a radial distancing with respect to the axis 52 by its intersection with the cylindrical side 85; the side 86 is delimited in the direction of a radial rapprochement with respect to axis 52 by intersection with a cylindrical side 87 revolving around this axis 52 towards which it is turned, this side 87 presenting a diameter which is approximately identical to that of the side 51 of the first section 49 of the rod 44, so as to establish a sliding contact between the sides 87 and 51; parallel to the axis 52, side 87 presents a length which is more or less identical to the length of the side 51 measured parallel to the axis 32, and it connects the side 86 to an annular, planar side 88, which is perpendicular to the axis 52 and of orientation opposite that of the side 86, the side 88 of which is approximately coplanar with the side 54 of the rod 44 of the control button 31 and connects, in the direction of a radial distancing with respect to the axis 52, the side 87 to the toothing 82 in this example in which the latter presents a minimum diameter which is greater than that of the side 51 of the first section 49 of the rod 44.

Thus, a guidance of the reel 16 is ensured on rotation around the axis 52 with respect to the first section 49 of the rod 44 of the control button 31, practically without the possibility of relative movement of the control button 31, of the casing box 28, of the component 62 and of the reel 16 parallel to the axes 32 and 52.

In addition, inside the first section 49 of the rod 44 of the control button 31 is placed, following a radial direction 89 with respect to the two axes 32 and 52, i.e., perpendicular to both, a blind hole 90 opening on to the side 51; inside of this blind hole 90 is mounted, for sliding following the direction 89 with respect to the rod 44 of the button 31, a piston 91 representing, towards the mouth of the blind hole 90 in the side 51, a side 92 in the form of a spherical convex cap centered on the axis 89; a helicoidal spring 93 of axis 89 is lodged inside the blind hole 90, compressed between the piston 91 and the closed end 94 of the blind hole 90, to solicit the piston 91 in the direction going outside the hole 90 following the direction 89, i.e., notably in the direction of a projection of the side 92 with respect to the side 51 of the first section 49 of the rod 44.

In a complementary manner, in the side 87 of the winding reel 16 is placed a concave spherical cap-shaped side 95, with its axis in a radial direction (not represented) with respect to the axis 52 and located at a same transversal level, with respect to this axis 52, as the direction 89, so that it can coincide with the latter such that the concave side 95 can be placed facing the mouth of the blind hole 90 in the side 51 and receive the convex side 92 of the piston 91, pushed by the spring 93.

Thus, the engagement of the side 92 of the piston 91 in the side 95 of the reel 16 under the action of the spring 93 ensures a mutual fastening, notably on relative rotation around the axis 52 and with respect to a rotation around the axis 32 with respect to the casing box 28, of the reel 16 and of the control button 31 as long as no coupling tends to cause the reel 16 to turn around the axis 52 with respect to the control button 31, or as long as such a coupling does not exceed a predetermined threshold, a function of the geometry of the sides 92 and 95 and the setting of the spring 93, which can potentially be controlled by any means within the knowledge of those skilled in the art; in this case, the control button 31—component 62 (still fastened to the control button 31)—reel 16 group behaves as a solidary entity, notably on rotation around the axis 32 with respect to the casing box 28; if, nonetheless, a couple tending to cause the reel 16 to turn with respect to the button 31 around the axis 52 with a value which exceeds this predetermined threshold appears, the spherical cap form, or any other appropriate form, of the convex side 92 of the piston 91 and of the concave side 95 of the winding reel 16 causes a retraction of the piston 91 inside of the blind hole 90, contingent on a complementary pressure from the spring 93, which permits a rotation of the reel 16 around the axis 52 with respect to the button 31, through relative sliding of the sides 87 and 51.

Such a couple can notably result from the application of tension on the flexible brace 112, the fourth section 25 of which penetrates to the interior of the housing defined by the casing box 28 and the control button 31, to wind up on the side 85 of the reel 16, through a passage 96 placed in the casing box 28, following a medial direction included in the plane passing through the axis 32 and combined with the plane III—III, to join an opening 97 in the side 34 of the casing box 28 to an opening 98 in the sides 38 and 39 of this casing box 28 at the intersection of these sides 38 and 39.

Thus, the operation of the device just described is as follows.

One will assume that the collar 5 and the cap 6 of the rod 4 initially occupy a closed position of the rod, or a position pressing against a skier's leg, and that the casing 12 occupies a position which is offset towards the rear and downward with respect to its retraction position, and, for example, a position pressing against the kick portion of the skier's foot, the flexible brace 112 being tightened between its end 13 connected to the pivot shaft 8, on one hand, and the reel 16 on which it is partially wound, after a rotation of the reel 16 in the winding direction 81; this initial state of the boot is illustrated in FIG. 2; the engagement of the pawl 74 in the ratchet toothing 68 prevents the button 31 from turning with respect to the casing box 28, around the axis 32, in the direction opposite the winding direction 81 and the piston 91, becoming engaged through its convex side 92 in the concave side 95 of the reel 16, connects the latter with the button 31; thus, the reel 16 is also prevented from turning around the axis 32, with respect to the casing box 28 in the direction opposite the winding direction 81, and holds the flexible brace 112.

To initiate the passage of the collar 5 and the cap 6 to the open position illustrated in FIG. 1 and to allow a passage of the casing 12 into retraction position, the user presses the end 79 of the lever 75 to disengage the pawl 74 from the ratchet toothing 68, which unlocks, with respect to a rotation around the axis 32 with respect to the casing box 28, in the direction opposite the winding direction 81, the group, which is then connected, formed by the control button 31 and the reel 16; the user can then apply a manual traction, towards the rear, on an upper zone of the cap 6, which is accompanied by a traction applied to the flexible brace 112, which translates into a rotation of the reel 16 in the direction opposite the winding direction 81 around the axis 32 with respect to the casing box 28, i.e., by an unwinding of the cable, which slides, during this movement, on the cap 6; in an analogous manner, with the foot if this opening of the rod 4 of the boot corresponds to a removal of the boot, or with the hand if this opening is prior to putting the boot on, the user then brings the shell 12, through an upward movement towards the front, to its retraction position contingent on a sliding of the flexible brace 12 on it and in the opening 20 and the keeper 23 of the collar 5; the end 79 of the lever 75 is next released.

Depending on the case, the user can then take the boot off or put it on.

In this last hypothesis, the user engages the foot in the shell 2 and the base of the leg in the rod 4, in open position, then acts manually on the control button 31, to cause its rotation in the winding direction 81, around the axis 32, with respect to the casing box 28; on a first occasion, while the casing 12 and the cap 6 are not in contact respectively with the skier's foot and leg, the flexible brace 112 presents only a negligible resistance to the winding on the reel 16, i.e., with respect to a rotation of the latter around the axis 32 with respect to the casing box 28, together with the control button 31; during this first winding phase, the reel 16 consequently remains connected to the control button 31, and the control button 31—component 62—reel 16 group behaves as a solidary unit and the reel 16 turns at the same angular speed as the control button 31 around the axis 32 with respect to the casing box 28; the flexible brace 112, while sliding in the keeper 19 of the shell 12 and on the latter, as well as behind the cap 6, causes a movement of the casing 12 towards the rear and downward, and a movement of the upper zone of the cap 6 forward, i.e., in the direction of a closing of the rod 4 with the collar 5.

When the casing 12 meets the obstacle presented by the kick portion of the foot in its movement downward and towards the rear, and this cap 6 meets the obstacle of the skier's leg in its movement towards the collar 5, the pursuit of the winding of the flexible brace on the reel 16, through the user's action on the button 31 to ensure its rotation in the direction 81 with respect to the casing box 28, around the axis 32, causes the appearance of an increasing tension in the flexible brace 112 and, when this increasing tension reaches a value resulting in the application of the reel 16, because of the winding of the flexible brace 112 on its side 85, for a moment, of axis 52, which is sufficient to eliminate the immobilization effect on the reel 16 with respect to the button 31 which ensures the engagement of the convex side 92 of the piston 91 in the concave side 95 of the reel 16, the reel 16 disconnects from the control button 31 through the retraction of the piston 91 inside the blind hole 90, and additional pressure of the spring 93, and the epicycloidal gear comprised of the toothed annular gears 72 and 82 substitutes for the direct transmission of the rotation movement between the control button 31 and the reel 16 to cause, contingent on a rotation of the reel 16 with respect to the control button 31 around the axis 52, a rotation or the reel 16 around the axis 32 with respect to the casing box 28 in the winding direction 81, at an angular speed which is lower with respect to that of the control button 31 but with a couple which is heightened with respect to that which the user applies to this button; thus, the winding of the flexible brace 112 continues, but at a lower speed assuming that the user continues to move the control button at 31 at the same angular speed, and with a greater coupling which allows tension to be progressively applied to the flexible brace 112, until the casing 12 and the cap 6 apply, respectively, to the skier's heel and leg, a pressure which is judged at once sufficient to ensure a proper maintenance of the boot and sufficiently low to be comfortable for the user; the pawl 74—ratchet wheel 68 group then resists the unwinding of the flexible brace 112, and retains the casing 112, and the cap 6 in position thus reached, which corresponds, for example, to that which is illustrated in FIG. 2.

Subsequently, the user can again release the foot and the leg by effecting the steps described in reference to FIG. 2.

Naturally, the mode for the implementation of the invention just described constitutes only a non-limitative example, and one skilled in the art may envision numerous variations of it without thereby departing from the framework of this invention; these variations may notably bear upon the provision of means for the regulation of the pressure of the spring 93, such means being known in the art, or on the replacement of the piston 91—spring 93—concave surface 95 assembly of the reel 16 with other couple-limiting means, intervening either to mutually fasten the reel 16 and the button 31 on rotation around the axis 32 with respect to the casing box 28, or to allow their rotation at different speeds; equally, the catch 74—ratchet toothing 68 assembly may act directly on the reel 16 instead of acting on it through the intermediary of the aforementioned couple limiting means, and it can be replaced by other means which allow the same function to be fulfilled.

In a general manner, any means may be adopted to establish two relations of transmission between the control button and the winding reel and to cause the establishment of either of these relations as a function of the tension of the flexible brace according to the described process, and to temporarily immobilize the flexible brace, which can be unlocked when desired, against unwinding with respsect to the reel.

What is claimed is:

1. In an alpine ski boot comprising (a) at least two rigid elements (2, 5, 6) defining a shell (2) receiving a foot and a rod (4) including a front collar (5) and a rear cap (6);

(b) means (8, 9) for the mutual assembly of said elements, defining a mutual articulation of said collar (5) and said cap (6) in a lower zone of said rod (4), about a relative pivoting axis (7) which is substantially horizontal and transversal with respect to a predetermined direction (8) of forward movement, such that said cap (6) and said collar (5) can move between the relative open position of said rod (4) and a relative, variable position of the pressing of said cap (6) and said collar (5) against a leg;

(c) a tarsal support casing (12), located inside said boot and movable with respect to said elements (2, 5, 6), between a retraction position in which it is adjacent to said collar (5), in a lower zone of said rod, and/or to said shell (2) in a front and upper zone thereof, and a position pressing downward towards the rear on a foot, said pressing position being variable and offset towards the rear and downward with respect to said retraction position;

(d) a flexible brace (112), substantially inextensible, having two ends (13, 15) a first (13) of which is solid with one of said elements (2, 5, 6) in immediate proximity to said axis (7), of a first side (10) of said boot and at its interior, said flexible brace (112) having, in addition, successively from said first end (13) to a second end (15), a first section (18) by-passing said tarsal support casing (12) through the front and above, at the interior of said boot, at a first level which is higher than that of said first end (13), a second section (22) passing through said collar (5) in a first lateral zone (21) of said rod (4), from a second side (11) of said boot opposite said first side (10) to a second level which is above that of said first section (18) and that of said relative pivoting axis (7), a third section (24) by-passing said cap (5) through the rear, outside said boot, and a fourth section (25) extending along said collar (5) in a second lateral zone (17) of said rod (4), outside of said boot, from said first side (10) approximately to said second level;

(e) means (20, 23) for guiding said second section (22) of said flexible brace (112) through said collar (5) in said first lateral zone (21) of said rod (4), to said second level;

(f) traction means (26) carried by said collar (5) in said second lateral zone (17) of said rod (4), substantially to said second level, for applying to said fourth section (25) of said flexible brace (112) traction adapted to selectively bring and maintain said cap (6) and said collar (5) in leg pressing position and said tarsal support casing (12) in foot pressing position, and to release said fourth section (25) of said flexible brace (112) and to allow passage of said cap (6) and of said collar (5) into open position and passage of said tarsal support casing (12) into retraction position, the improvement comprising (g) a winding reel (16) for said fourth section (25) of said flexible brace (112), said second end (15) of which is solid with a zone of said reel (16);

(h) means (40, 62, 31) carried by said collar (5), for defining an axis (32) of rotation of said reel (16) with respect to said collar (5), or first axis;

(i) a control knob (31) for said reel (16) on rotation about said first axis (32), with respect to said collar (5), in at least one predetermined direction (81) for the winding of said fourth section (25) of said flexible brace (112);

(j) means (40, 62) carried by said collar (5) for defining an axis of rotation (32) of said control knob (31) with respect to said collar (5), or second axis;

(k) first means (91) of kinematic connection between said control knob (31) and said reel (16) on rotation about said second and first axes (32), respectively, with respect to said collar (5), said first means (91) of kinematic connection introducing a first relationship of transmission of the rotation of said knob (31) to the rotation of said reel (16);

(l) second means (72, 82) of kinematic connection between said control knob (31) and said reel (16) on rotation about said second and first axs (32), respectively, with respect to said collar (5), said second (72, 82) means of kinematic connection introducing a second relationship of transmission of the rotation of said knob (31) to the rotation of said reel (16), reduced with respect to said first relationship;

(m) means (92, 93, 95) of automatic switching between said first and second means of kinematic connection (91, 72, 82), for automatically actuating said first means (91) of kinematic connection when said flexible brace (112) is subjected to traction stress below a predetermined threshold, and said second means (73, 82) of kinematic connection when said flexible brace (112) is subjected to traction stress above said threshold; and (n) means (74, 62) for temporary immobilization of said reel (16) on rotation about said first axis (32), with respect to said collar (5), in a direction opposite to said predetermined winding direction (81).

2. The improvement according to claim 1, wherein said flexible brace (112) follows an ascending trajectory from its said first end (13) to said second section (22), over substantially the entire said first section (18).

3. The improvement according to claim 1 or 2, wherein said tarsal support casing (12) comprises, towards the front, a keeper (19) for guiding said first section of said flexible brace (112).

4. The improvement according to claim 1 or 2, wherein said first and second axes (32) are identical.

5. The improvement according to claim 4, wherein said control knob (31) and said reel (16) have means (51, 87) defining, in a complementary manner, a relative rotation axis (52), or third axis, parallel to said first and second axes (32) and parallel thereto, said first means (91) of kinematic connection comprising means for mutual attachment of said reel (16) and said control knob (31) in opposition to relative rotation about said third axis (52), said second means (72, 82) of kinematic connection comprising two mutually engaging toothed annular gears (72, 82) including a first toothed annular gear (72) having for its axis said first and second combined axes (32), and solid with said control knob (31) on rotation about said first and second combined axes (32) with respect to said collar (5), and a second annular gear (82) having for its axis said third axis (52) and solid with said reel (16), on rotation about said third axis (52) with respect to said control knob (31), said second annular gear (82) having a diameter greater than that of said first annular gear (72) and defining, with the latter, and epicycloidal gear train, and said means for automatic switching (92, 93, 95) comprising couple limiting means integrated with said means (91) for mutual attachment of said reel (16) and said control knob (31) in opposition to relative rotation about said third axis (52).

6. The improvement according to claim 1 or 2, wherein said means (68, 74) for temporary immobilization of said reel (16) include a pawl-toothing system with ratchets which can be unlocked manually.

7. The improvement according to claim 6, wherein said toothing system (68) has for its axis said first and second combined axes (32), and is solid with said control knob (31) on rotation about said first and second combined axes (32) with respect to said collar (5), a pawl (74) being movably mounted with respect to said collar (5) and resiliently solicited in the direction of an engagement with a ratchet wheel (68), control means (79) being provided for said pawl (74) in the direction of disengagement from said ratchet wheel (68).

* * * * *